US009386361B2

(12) United States Patent
Sprinkle

(10) Patent No.: US 9,386,361 B2
(45) Date of Patent: Jul. 5, 2016

(54) LOUDSPEAKER HORN

(71) Applicant: Harman International Industries, Incorporated, Stamford, CT (US)

(72) Inventor: Charles M. Sprinkle, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/371,162

(22) PCT Filed: Jan. 8, 2013

(86) PCT No.: PCT/US2013/020684

§ 371 (c)(1),
(2) Date: Jul. 8, 2014

(87) PCT Pub. No.: WO2013/106335

PCT Pub. Date: Jul. 18, 2013

(65) Prior Publication Data

US 2015/0014089 A1 Jan. 15, 2015

Related U.S. Application Data

(60) Provisional application No. 61/584,560, filed on Jan. 9, 2012.

(51) Int. Cl.

| | |
|---|---|
| ***H04R 1/30*** | (2006.01) |
| ***H04R 1/02*** | (2006.01) |
| ***H04R 1/34*** | (2006.01) |

(52) U.S. Cl.
CPC .. *H04R 1/02* (2013.01); *H04R 1/30* (2013.01); *H04R 1/345* (2013.01)

(58) Field of Classification Search
CPC ..... H04R 1/30; H04R 1/323; H04R 1/345
USPC ..... 181/192; 381/338, 340
See application file for complete search history.

(56) References Cited

U.S. PATENT DOCUMENTS

| | | | | |
|---|---|---|---|---|
| 4,580,655 | A * | 4/1986 | Keele, Jr. | 181/192 |
| 5,020,630 | A | 6/1991 | Gunness | |
| 5,991,421 | A * | 11/1999 | Faraone | 381/338 |
| 7,275,621 | B1 * | 10/2007 | Delgado, Jr. | 181/192 |
| 2001/0036290 | A1 * | 11/2001 | Delgado, Jr. | H04R 1/00 381/340 |
| 2003/0133584 | A1 | 7/2003 | Werner | |
| 2009/0057052 | A1 | 3/2009 | Delgado, Jr. | |
| 2011/0123057 | A1 * | 5/2011 | Pazandeh | 381/340 |

FOREIGN PATENT DOCUMENTS

EP 0140465 A2 5/1985

OTHER PUBLICATIONS

European Patent Office, International Search Report and Written Opinion of the International Searching Authority of PCT/US2013/020684, May 2, 2013, WIPO, 11 pages.

* cited by examiner

*Primary Examiner* — Jeremy Luks
(74) *Attorney, Agent, or Firm* — Alleman Hall McCoy Russell & Tuttle LLP

(57) ABSTRACT

A horn for use with a loudspeaker may include an entrance disposed at a first axial end of the horn and configured to receive a driver. A mouth may be disposed at a second axial end of the horn opposite the entrance. A contoured surface may extend between the entrance and the mouth. A cross sectional shape of a coverage pattern of audible sound emitted by the loudspeaker coupled with the horn may be independent of a shape of the entrance and a shape of the mouth.

20 Claims, 21 Drawing Sheets

LOUDSPEAKER HORN

PRIORITY CLAIM

This application is the U.S. National Phase of International PCT Application Serial No. PCT/US2013/020684, entitled "Loudspeaker Horn," filed Jan. 8, 2013, which claims the benefit of priority from U.S. Provisional Application No. 61/584,560, filed Jan. 9, 2012, all of which are hereby incorporated by reference in their entirety for all purposes.

BACKGROUND OF THE INVENTION

1. Technical Field

The invention relates to loudspeakers and, more particularly, to acoustical horns or waveguides for use in loudspeakers.

2. Related Art

Typically, a loudspeaker includes a driving unit that is coupled to a horn. The large end of the horn, called the "mouth," typically has an area large enough to radiate sound efficiently at a desired low frequency. The small end of the horn, called the "throat," has an area selected to match the acoustic impedance and exit diameter of the driving unit and to reduce distortion of the acoustic signal.

The loudspeaker horn guides the acoustic signal or acoustic energy into particular directions or regions. The loudspeaker horn surfaces that constrain and control the radiation of acoustic energy are commonly referred to as an acoustic waveguide. The surfaces of an acoustic waveguide in a loudspeaker typically produce a coverage pattern of a specified total coverage angle that may differ horizontally and vertically. The coverage angle is a total angle in any plane of observation (although typically horizontal and vertical orthogonal planes are used). The coverage angle is evaluated as a function of frequency and is defined to be the angle at which the intensity of sound, or sound pressure level (SPL), is half of the SPL on the axis (the reference axial direction is usually normal to the throat of the driver).

SUMMARY

A horn for use with a loudspeaker may include an entrance disposed at a first axial end of the horn and configured to receive a driver. A mouth may be disposed at a second axial end of the horn opposite the entrance. A contoured surface may extend between the entrance and the mouth. A cross sectional shape of a coverage pattern of audible sound emitted by the loudspeaker coupled with the horn may be independent of a shape of the entrance and a shape of the mouth.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
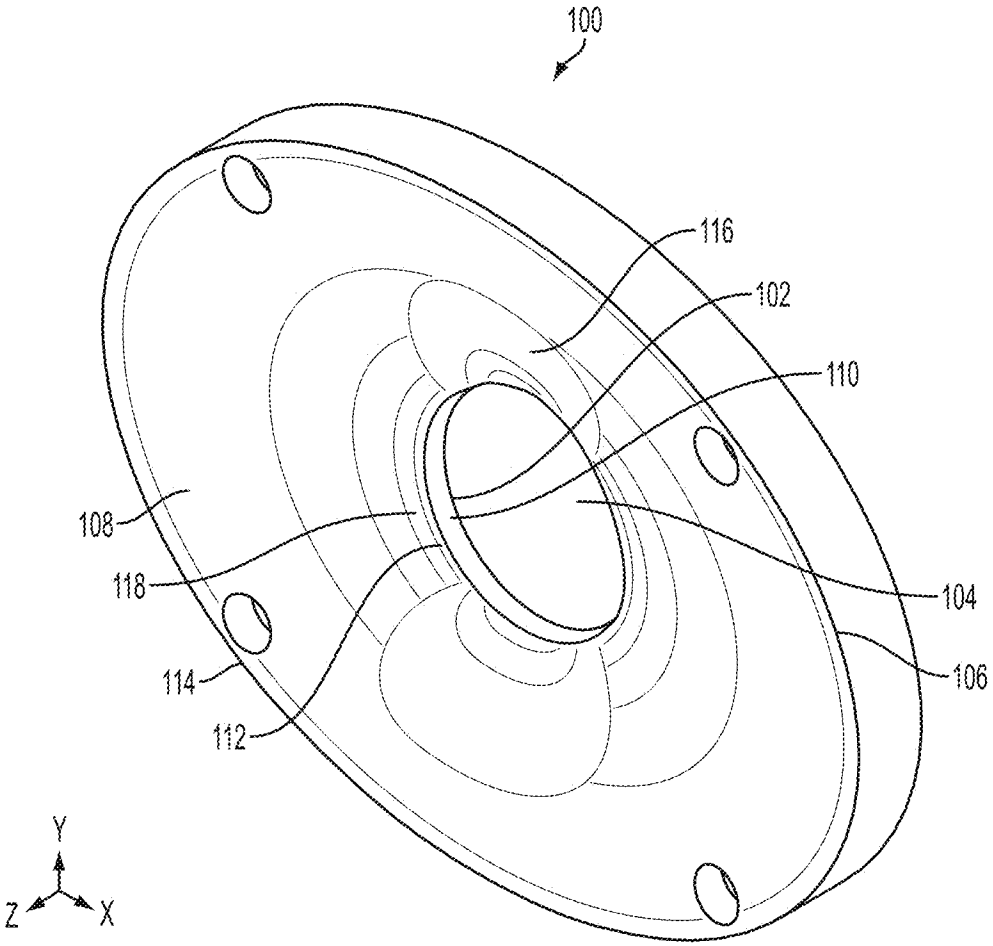
FIG. 1 illustrates a perspective view of one example of a horn for use in a loudspeaker.
Figure 2:
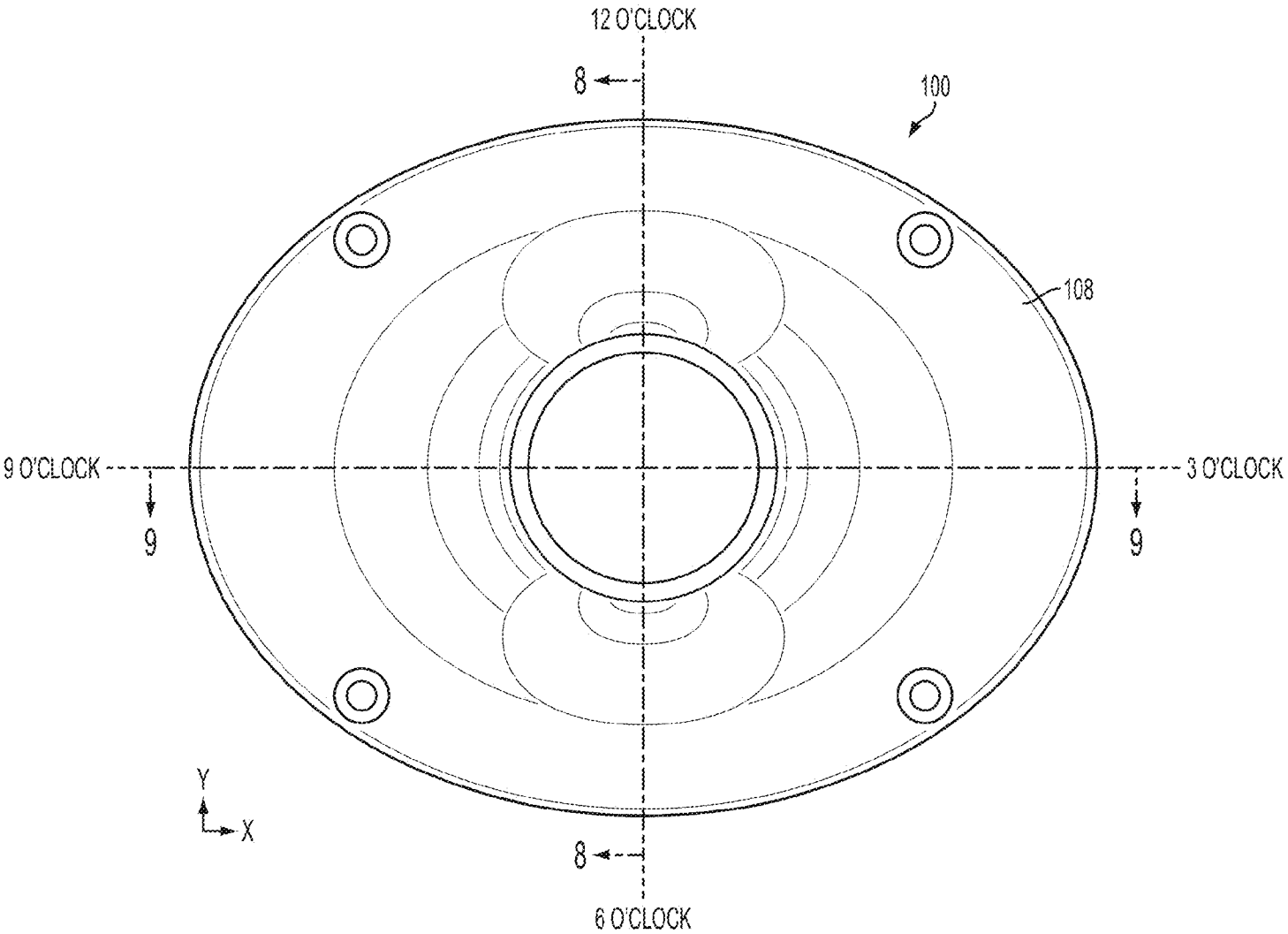
FIG. 2 illustrates a front view of the horn of FIG. 1.
Figure 3:
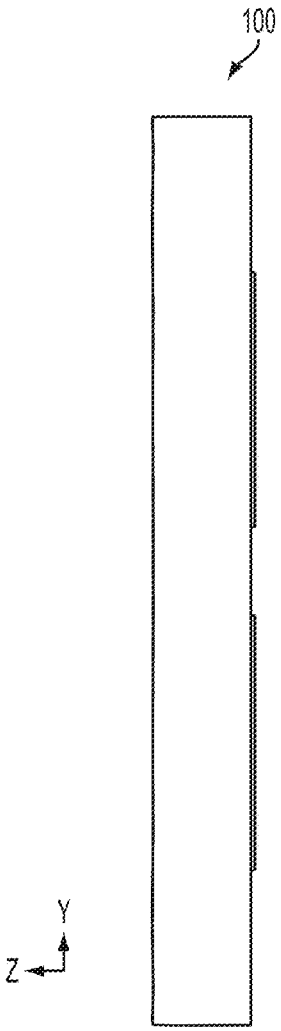
FIG. 3 illustrates a side view of the horn of FIG. 1.
Figure 4:
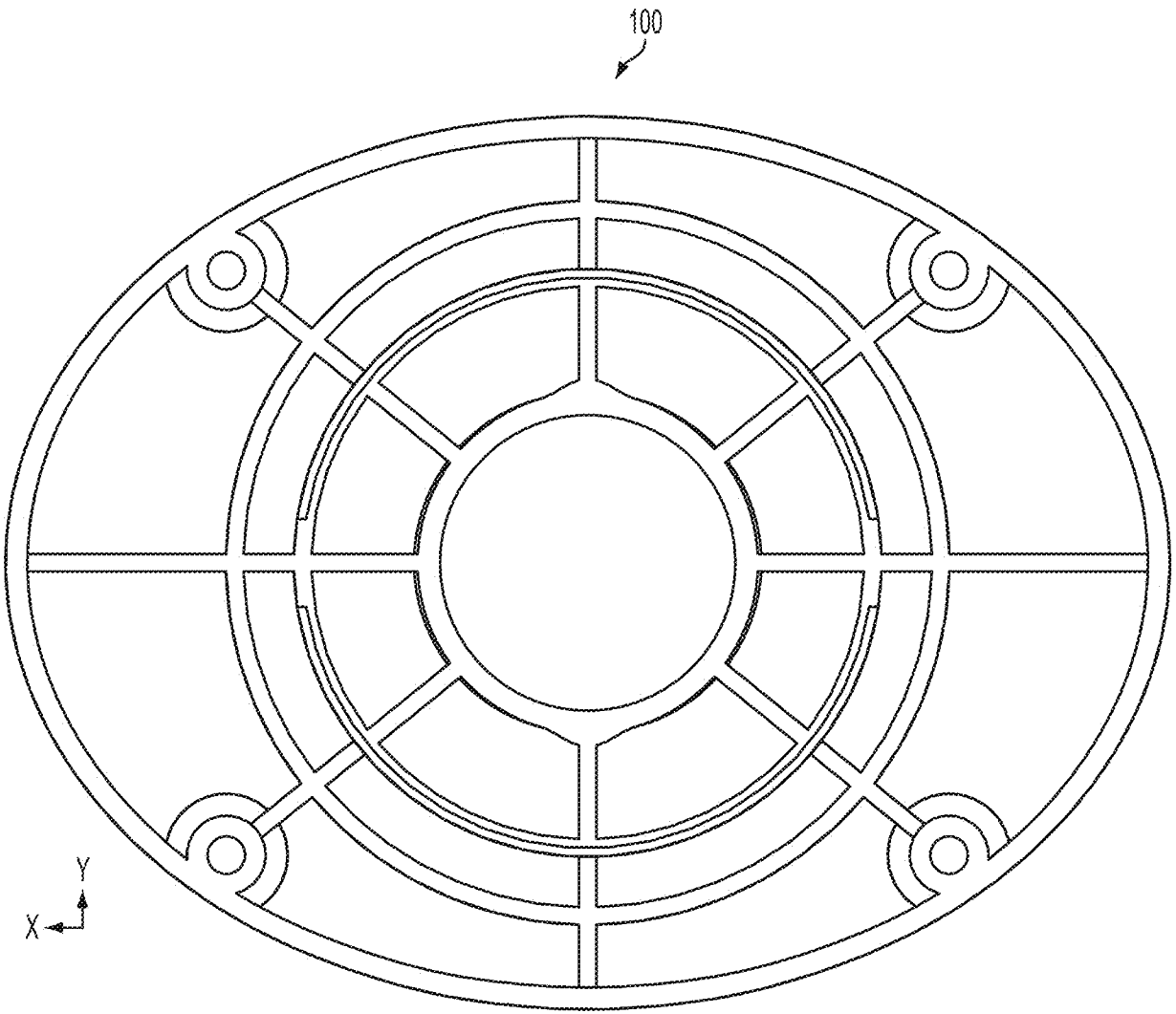
FIG. 4 illustrates a rear view of the horn of FIG. 1.
Figure 5:
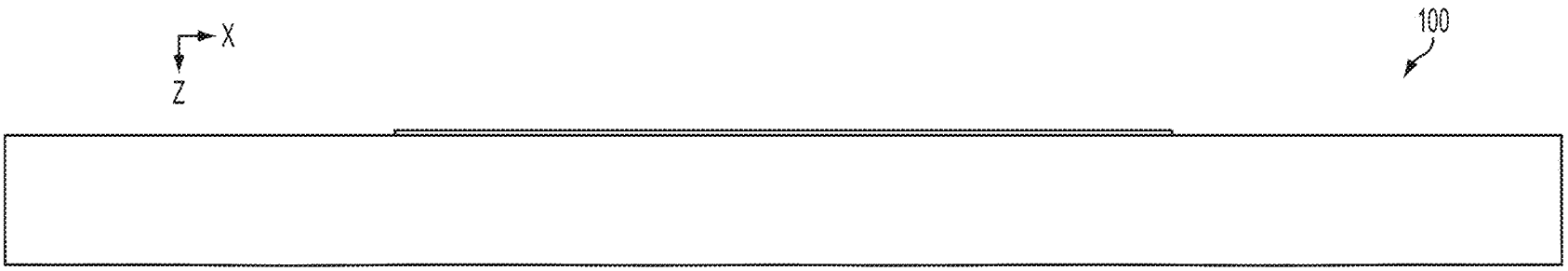
FIG. 5 illustrates a top view of the horn of FIG. 1.
Figure 6:
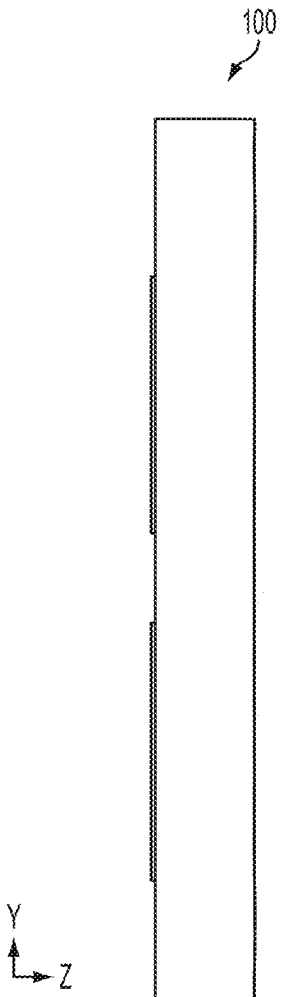
FIG. 6 illustrates a side view of the horn of FIG. 1.
Figure 7:
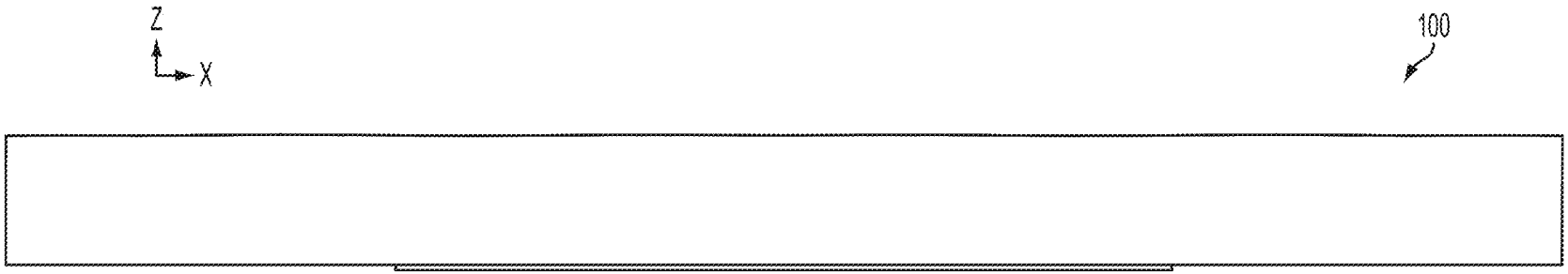
FIG. 7 illustrates a bottom view of the horn of FIG. 1.

A loudspeaker may include a horn or a waveguide, which may define the coverage pattern of the loudspeaker in one or more planes. The horn or waveguide may include an entrance, which may be positioned at a first axial end of the horn or waveguide. The entrance may be positioned on an entrance plane that is perpendicular to a longitudinal axis of the horn or waveguide. The longitudinal axis may be a line that is perpendicular to the entrance plane and intersects the entrance plane at the center of the entrance. The horn or waveguide may or may not be symmetrical about the longitudinal axis. The entrance may be configured to receive a driver. The horn or waveguide may include a mouth disposed at a second axial end of the horn or waveguide opposite the entrance. The horn or waveguide may include a contoured surface extending between the entrance and the mouth. The contoured surface may be an inner surface defining a cavity within the horn or waveguide. The contoured surface may include, for example, a frustoconical surface or a plurality of walls arranged relative to one another to from the cavity. The horn or waveguide may include a throat extending between the entrance and the contoured surface. For example, the contoured surface may have a first axial end positioned near the entrance and a second axial end positioned near the mouth. The throat may extend from the entrance to the first axial end of the contoured surface to couple the contoured surface to the entrance. The throat may be configured as a tubular member defined by one or more walls. In one example, the cross sectional area of the throat transverse to the longitudinal axis of the horn or waveguide may expand along the longitudinal axis of the horn or waveguide. For example, the cross sectional area of the throat may expand exponentially. In other examples, the cross sectional area of the throat may remain substantially constant, contract, or any combination thereof. The terms "horn" and "waveguide" may be used interchangeably herein, and are defined to include any form of mechanism or device having an entrance and a mouth that can be placed the vicinity of a loudspeaker to affect or modify the directivity or pattern of at least a portion of audible sound waves produced by the loudspeaker.

In one example, an elliptical waveguide may define the coverage pattern of a loudspeaker in one plane (i.e., the design plane). The elliptical waveguide may include a contoured surface having a generally frustoconical shape. A cross section of the contoured surface taken transverse to the longitudinal axis of the waveguide may have an elliptical shape. The elliptical waveguide may lack a throat. In other words, the throat may be omitted, and the first axial end of the contoured surface may be positioned at the entrance of the waveguide. The design plane may be a plane including the longitudinal axis of the elliptical waveguide and the major axis of the elliptical shaped cross section of the contoured surface. The coverage angle of audible sound emitted by the loudspeaker in planes other than the design plane may be at least partially constrained by the shape of the elliptical waveguide and the coverage angle in the design plane. In other words, the coverage angle of sound waves emitted by the loudspeaker in planes other than the design plane may be at least partially dependent on or affected by the geometry of the waveguide and the coverage angle of the loudspeaker in the design plane. In this manner, the coverage pattern of sound waves emitted by the loudspeaker may be at least partially constrained by the shape of the elliptical waveguide and the coverage angle in the design plane. As used herein, the terms "coverage pattern" or "pattern" of sound waves refers to at least one of, or both of, the directivity and propagation behavior of sound waves radiating from a loudspeaker.

In another example, a bi-radial horn may at least partially define the coverage angle of sound waves emitted by a loudspeaker in multiple planes (i.e., multiple design planes). The bi-radial horn may include a first pair of walls positioned opposite one another and a second pair of walls positioned opposite one another. The first pair of walls may be mirror images of one another. The second pair of walls may be mirror images of one another. The first pair of walls and the second pair of walls may be arranged relative to one another to form the contoured surface and the cavity of the bi-radial horn. A first design plane may be a plane including the longitudinal axis of the bi-radial horn and bisecting each of the first pair of walls. In one example, the first design plane may be a horizontal plane. A second design plane may be a plane including the longitudinal axis of the bi-radial horn and bisecting each of the second pair of walls. In one example, the second design plane may be a vertical plane. The coverage angle of sound waves emitted by the loudspeaker in planes other than the design planes may be at least partially constrained by the shape of the bi-radial horn and the coverage angles in the design planes. In other words, the coverage angle of the loudspeaker in planes other than the design planes may be at least partially dependent on or affected by the coverage angles of sound waves emitted by the loudspeaker in the design planes. In this manner, the coverage pattern of sound waves emitted by the loudspeaker may be at least partially constrained by the shape of the bi-radial horn and the coverage angles in the design planes.

In other examples, a horn or waveguide may define the coverage angles of a loudspeaker in three or more planes (i.e., three or more design planes). FIGS. 1-9 illustrate one example of a horn 100, which may define the coverage angle of a loudspeaker in three or more planes. The horn 100 includes an entrance 102 positioned at a first axial end of the horn 100. The entrance 102 may have any geometric shape including, for example, circular, elliptical, rectangular, or any other shape. In the example shown in FIGS. 1-9, the entrance 102 has a circular shape. The entrance 102 is positioned on an entrance plane that is perpendicular to a longitudinal axis 104 of the horn 100. The entrance 102 may be configured to receive a driver, such as a tweeter loudspeaker operating in the range of 5 kHz to 20 kHz. The horn 100 includes a mouth 106 disposed at a second axial end of the horn opposite the entrance 102. The mouth 106 may have any geometric shape. In the example shown in FIGS. 1-9, the mouth 106 has an elliptical shape. The mouth 106 may be planar as shown in FIGS. 1-9 or non-planar (e.g., curved). The horn 100 includes a contoured surface 108 extending between the entrance 102 and the mouth 106. The contoured surface 108 defines a cavity within the horn 100.

The horn 100 includes a throat 110 extending between the entrance 102 and the contoured surface 108. In the example shown in FIGS. 1-9, the contoured surface 108 has a first axial end 112 positioned near the entrance 102 and a second axial end 114 positioned near the mouth 106, and the throat 110 extends from the entrance to the first axial end of the contoured surface to couple the contoured surface and the entrance to one another. In one example, the transition between the throat 110 and the contoured surface 108 may be smooth and/or continuous. In other examples, the transition between the throat 110 and the contoured surface 108 may be discontinuous and/or abrupt (e.g., a stepped transition). The throat 110 may be configured to fill the gap between the first axial end 112 of the contoured surface 108 and the entrance 102. In this manner, the geometry (e.g., the size and/or the shape) of the contoured surface 108 may be independent of the geometry of the entrance 102, and the geometry of the throat 110 may be dependent on the geometry of the contoured surface and/or the geometry of the entrance.

Figure 8:
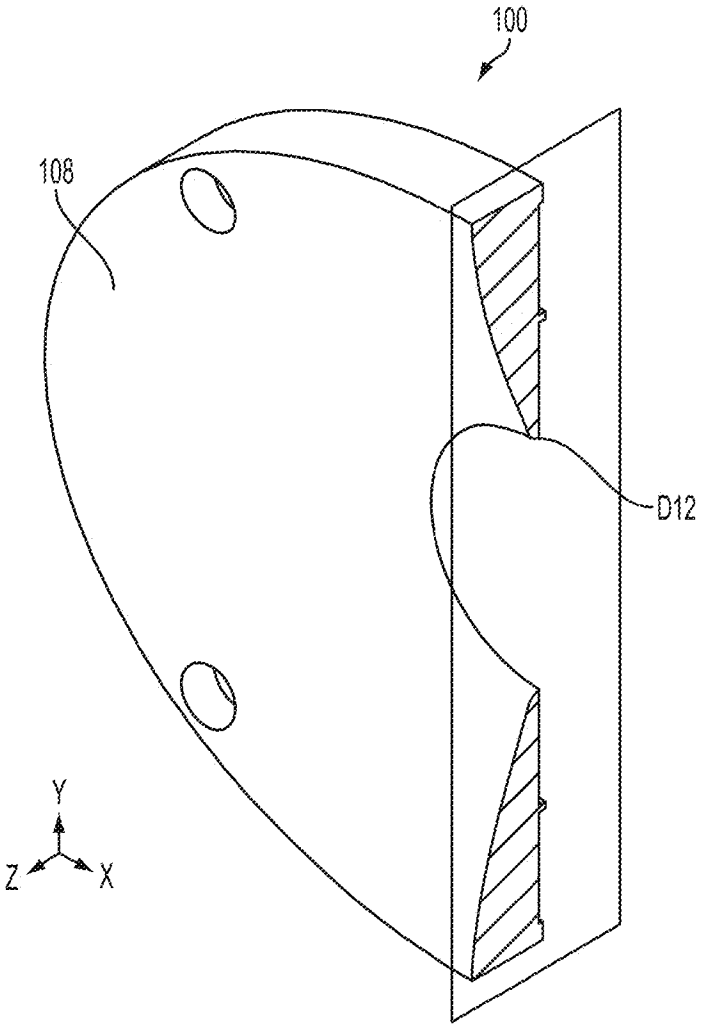
FIG. 8 illustrates a cross sectional view of the horn of FIG. 1 taken along line 8-8 of FIG. 2.
Figure 9:
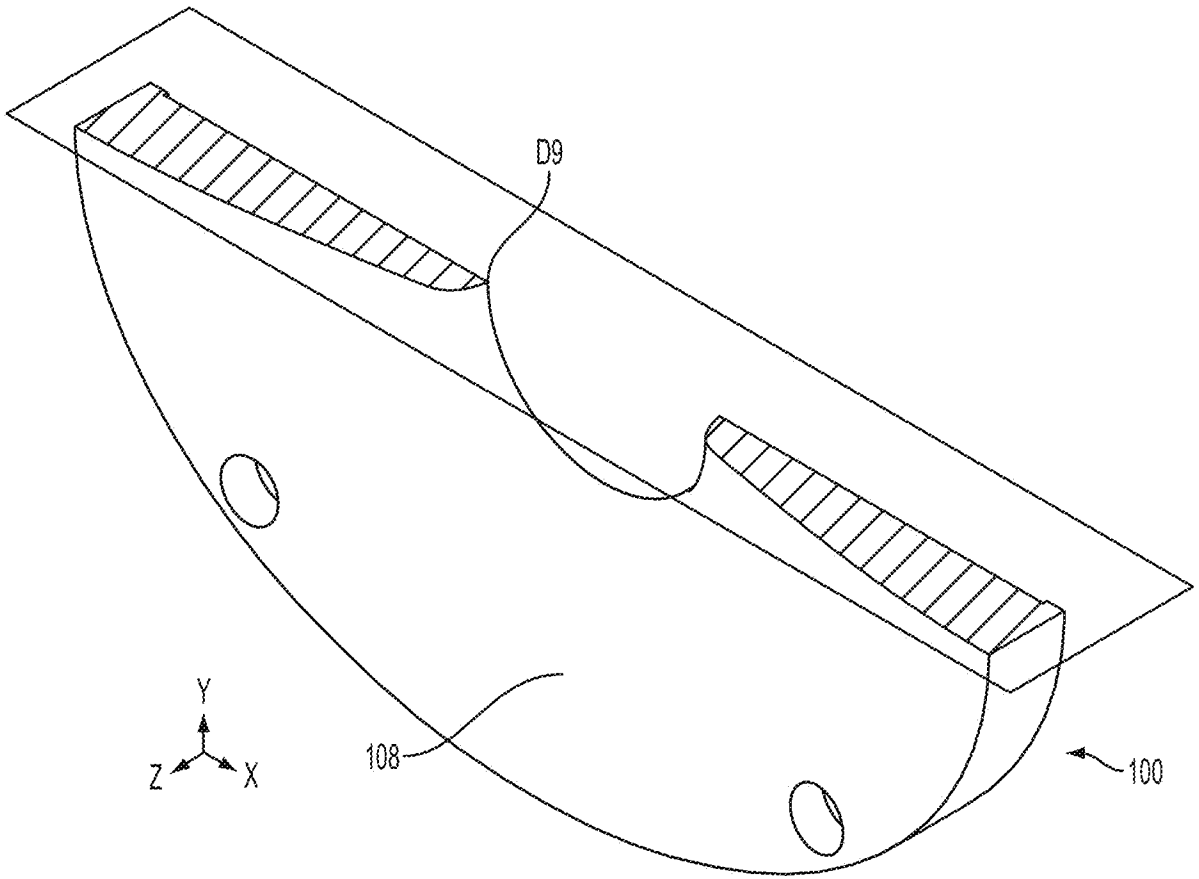
FIG. 9 illustrates a cross sectional view of the horn of FIG. 1 taken along line 9-9 of FIG. 2.

The throat 110 includes a wall defining a tubular segment extending between the entrance 102 and the contoured surface 108. In one example, the wall of the throat 110 may be substantially perpendicular to the entrance plane. In other examples, the wall of the throat 110 may be positioned at any angle relative to the entrance plane such that the passageway extending longitudinally within the tubular segment may have a tapered cross section. A longitudinal axis of the throat 110 may be substantially aligned with the longitudinal axis of the horn 100 (i.e., the throat may be substantially coaxial with the horn). A depth of the throat 110 may be defined as the longitudinal distance between the entrance 102 and the first axial end 112 of the contoured surface 108. The depth of the throat 110 may vary around the circumference of the throat. In other words, the longitudinal distance between the entrance 102 and the first axial end 112 of the contoured surface 108 may vary around the circumference of the entrance 102. FIGS. 8-9 show cross sectional views of the horn 100 taken along lines 8-8 and 9-9, respectively, in FIG. 2. The depth of the throat 110 at a 12 o'clock position (shown as D12), as shown in FIG. 8, is less than the depth of the throat 110 at a 9 o'clock position (shown as D9) as shown in FIG. 9. In one example, the depth of the throat 110 may vary continuously around the circumference of the throat between the depth D12 and the depth D9 as shown in FIGS. 1-9. In other words, the depth of the throat 110 may taper around the circumference of the throat. In other examples, the throat may include abrupt transitions between various depths of the throat. For example, the abrupt transitions may include a step, an offset, a stagger, a shoulder, a depression, and/or a dome. In one example, the wall of the throat 110 may be continuous around the circumference of the entrance 102 as shown in 1-9. In other examples, the wall of the throat may be discontinuous. In other words, the wall of the throat may not extend continuously around the circumference of the entrance. In one example, the contoured surface may be in contact with the entrance at a portion of the circumference of the entrance corresponding to a discontinuous section of the wall of the throat (e.g., a void or gap in the wall of the throat).

The varying depth of the throat 110 may correspond to a varying longitudinal distance between the first axial end 112 of the contoured surface 108 and the entrance plane circumferentially around the entrance 102. Such a varying longitudinal distance may be the result of one or more surface irregularities or predetermined variations included in the contoured surface 108 at one or more predetermined locations. The surface irregularities may include for example, a dimple, a protuberance, or any continuous or non-continuous variation of the contoured surface 108. The surface irregularity may be a non-uniform portion of an otherwise uniform surface. For example, the surface irregularity may include a dimple or a protuberance in an otherwise uniform straight (e.g., planar) or curved (e.g., exponential, parabolic, hyperbolic, conical, flared, and/or rounded) surface. In the example shown in 1-9, the contoured surface 108 includes dimples 116 positioned radially at approximately 12 o'clock and 6 o'clock and longitudinally near the first axial end 112 of the contoured surface. The dimples 116 may correspond to a minimum depth D12 of the throat 110. In the example shown in FIGS. 1-9, the contoured surface 108 also includes protuberances 118 positioned radially at approximately 3 o'clock and 9 o'clock and longitudinally near the first axial end 112 of the contoured surface. The protuberances 118 may correspond to a maximum depth D9 of the throat 110. A cross section of the horn 100 taken transverse to the longitudinal axis of the horn at the longitudinal position of the dimples 116 and/or the protuberances 118 may have a shape that is a non-polygonal closed curve that is neither a circle nor an ellipse. In other words, the cross section may be anon-circular and non-elliptical closed curve that does not include any straight line segments.

Figure 10:
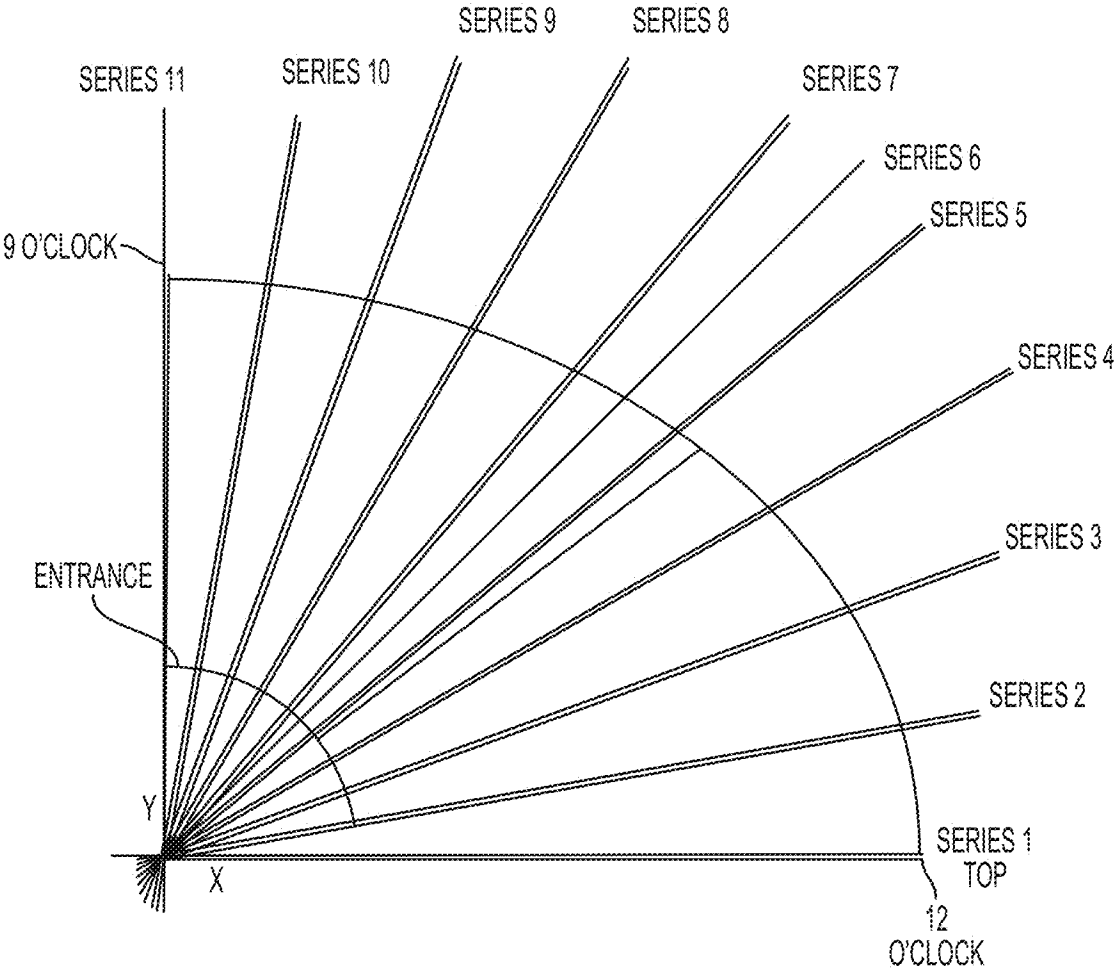
FIGS. 10-11 illustration a varying depth of a throat of the horn of FIG. 1.
Figure 11:
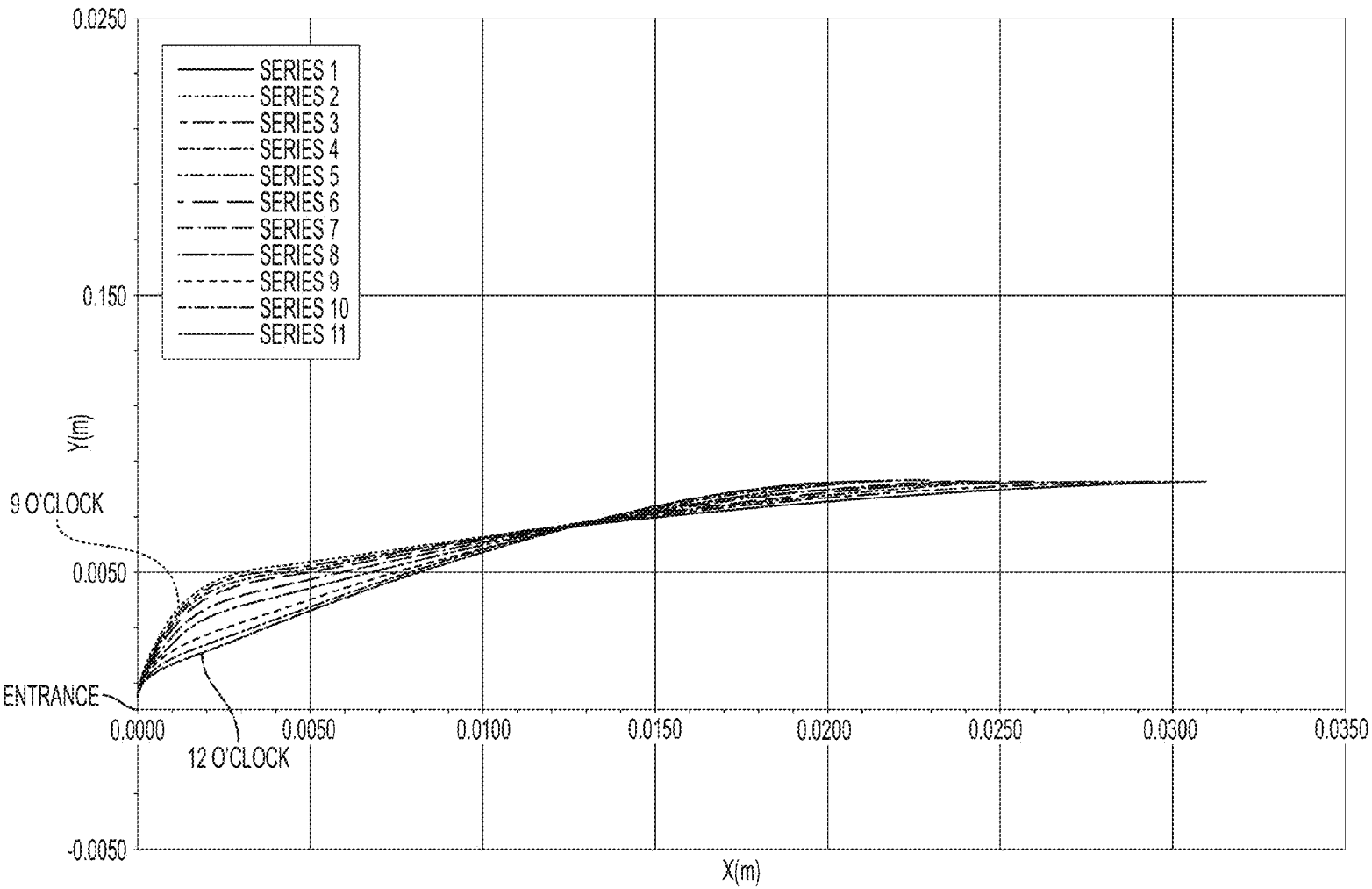
Figure 12:
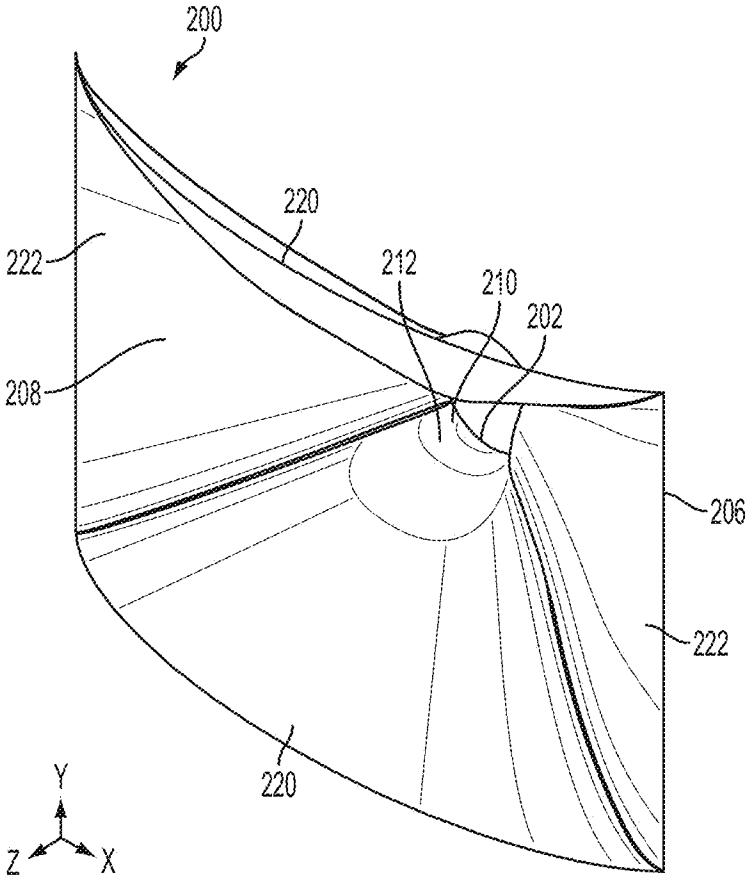
FIG. 12 is a perspective view of another example of a horn for use in a loudspeaker.
Figure 12A:
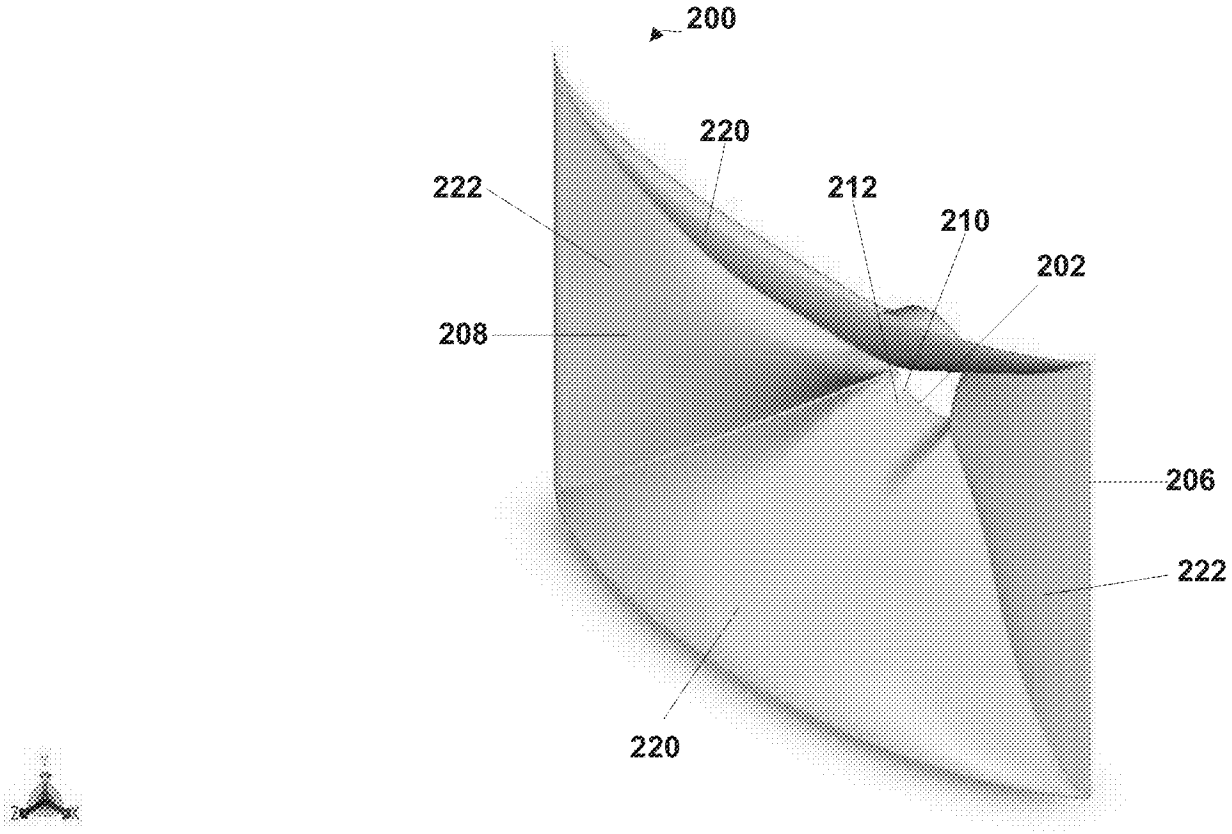
FIG. 12A is a 3-dimensional rendering of the view shown in FIG. 12.
Figure 13:
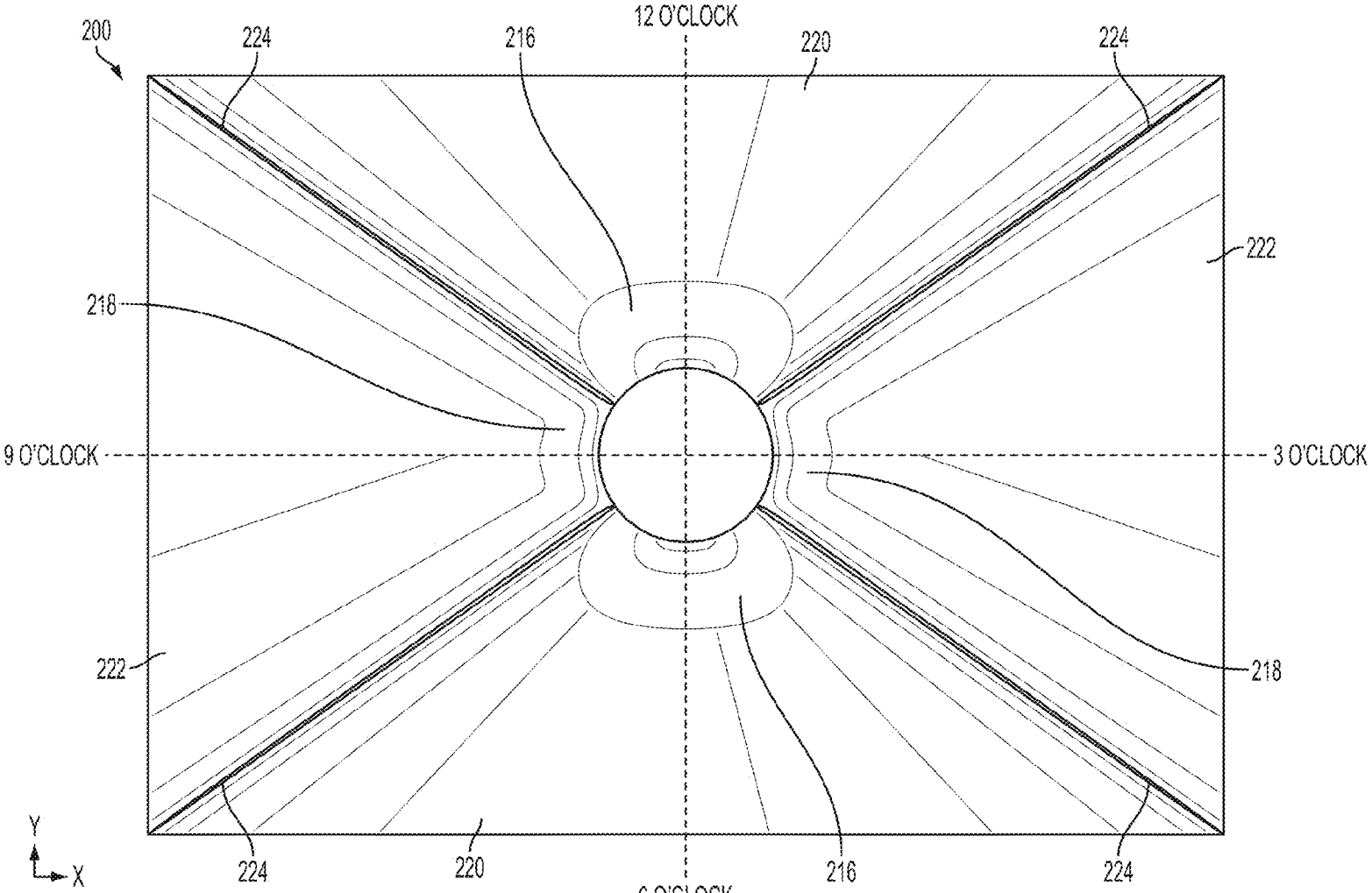
FIG. 13 illustrates a front view of the horn of FIG. 12.
Figure 13A:
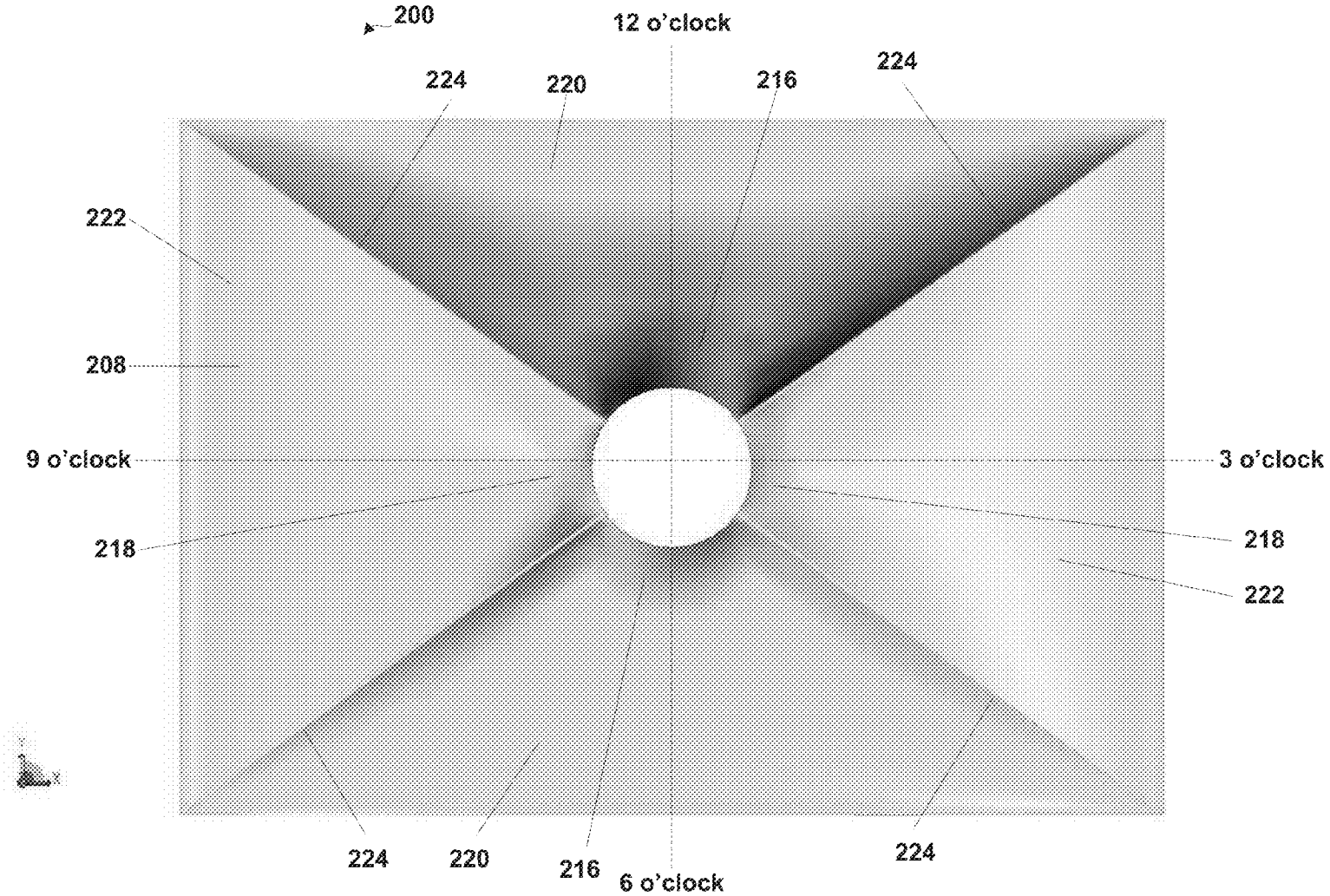
FIG. 13A is a 3-dimensional rendering of the view shown in FIG. 13.
Figure 14:
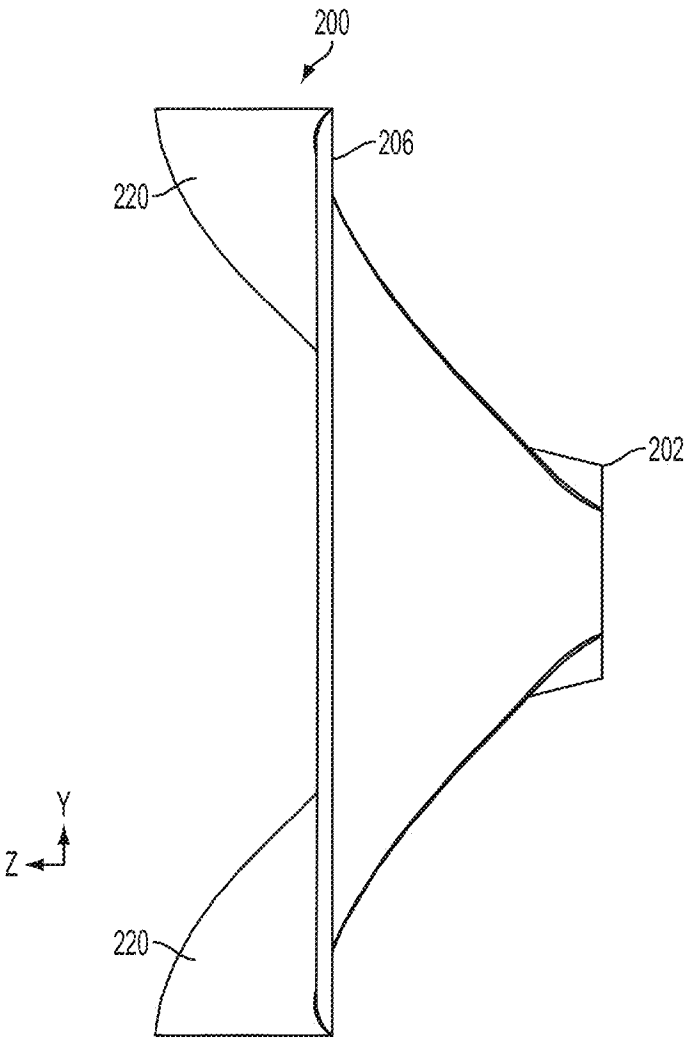
FIG. 14 illustrates a side view of the horn of FIG. 12.
Figure 15:
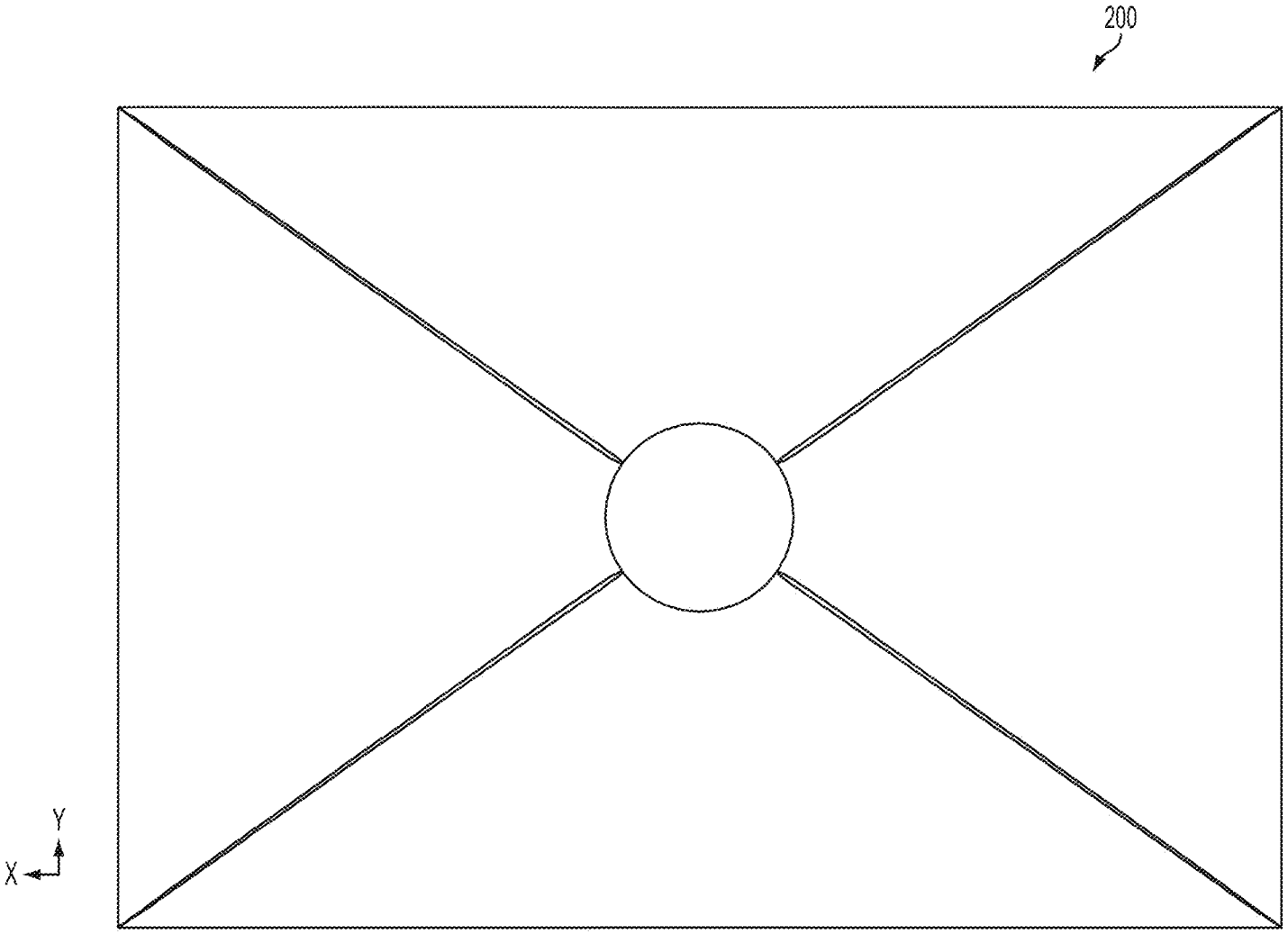
FIG. 15 illustrates a rear view of the horn of FIG. 12.
Figure 16:
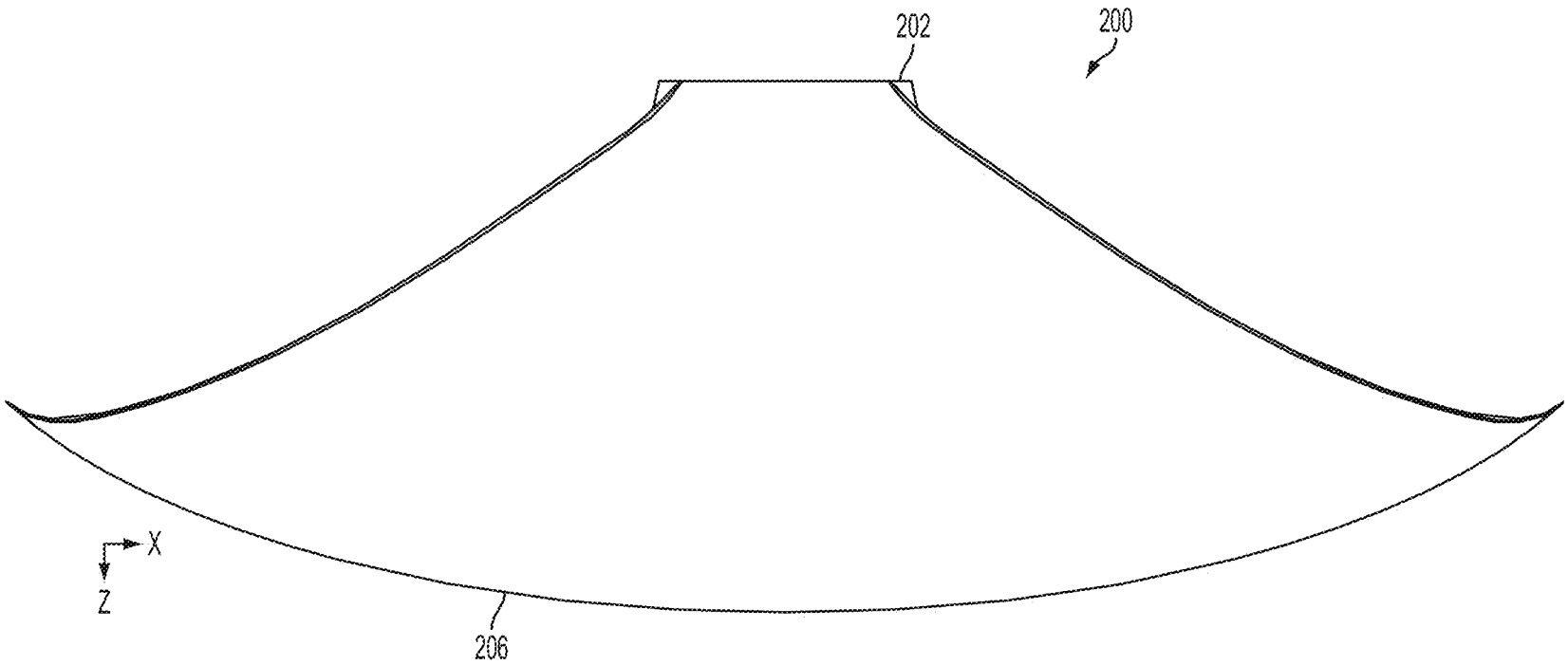
FIG. 16 illustrates a top view of the horn of FIG. 12.
Figure 17:
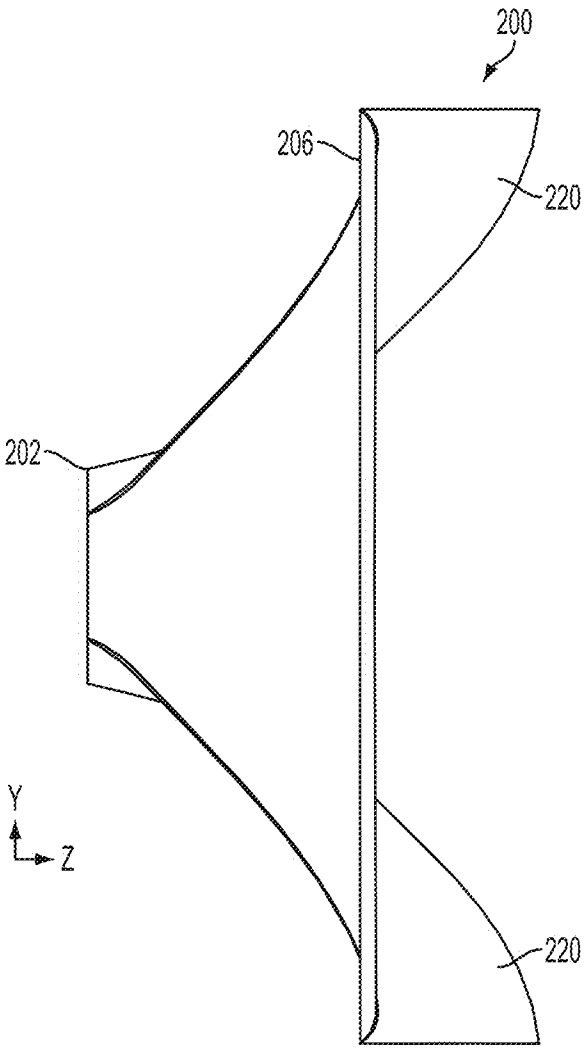
FIG. 17 illustrates a side view of the horn of FIG. 12.
Figure 18:
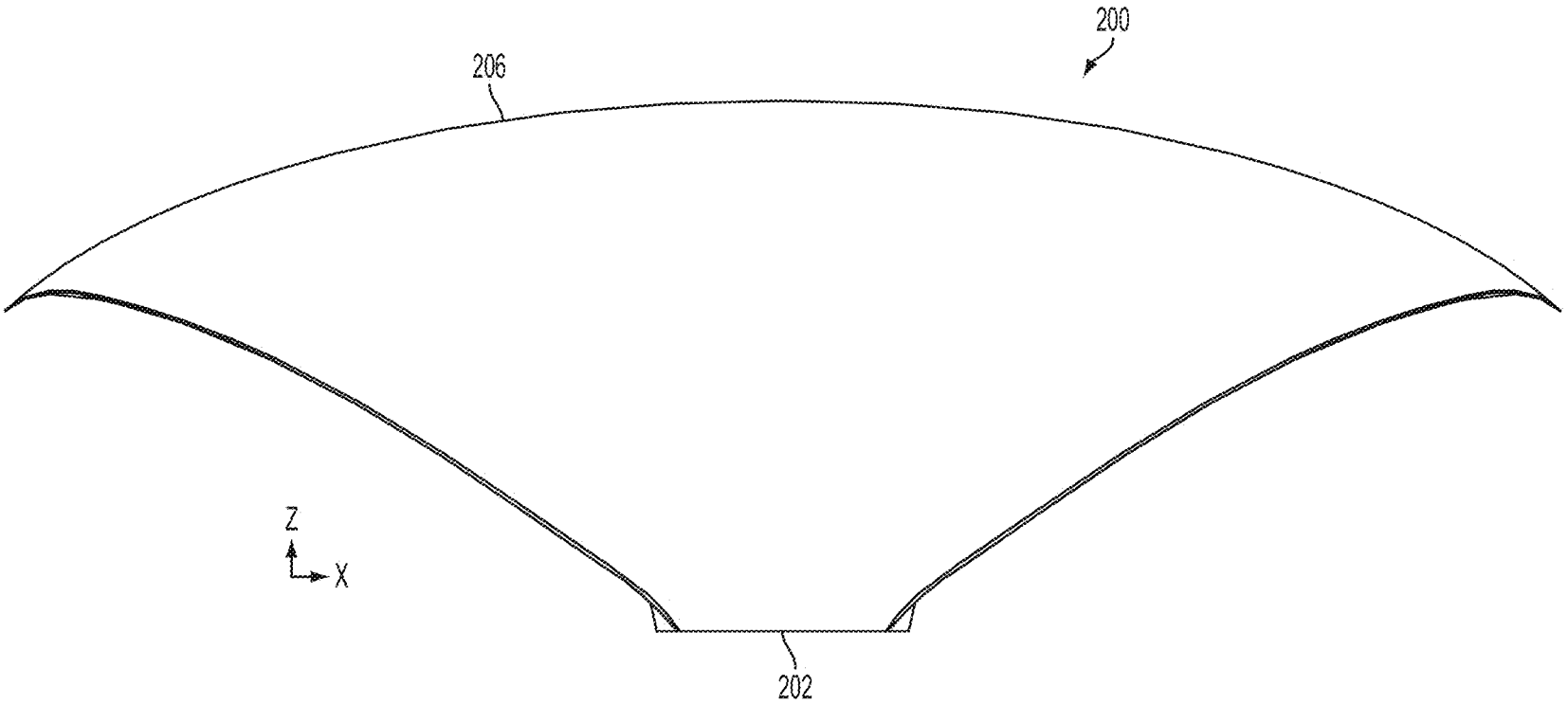
FIG. 18 illustrates a bottom view of the horn of FIG. 12.

FIGS. 10-11 are graphical illustrations of the varying depth of the throat 110. FIG. 11 illustrates the relationship between the longitudinal distance between the entrance plane and the horn 100 (e.g., the throat 110 or the contoured surface 108) and the radial distance from the entrance 102 in the various angular directions between 12 o'clock and 9 o'clock as shown in FIG. 10. As shown in FIG. 11, the longitudinal distance between the entrance plane and the horn 100 initially increases more rapidly at 9 o'clock (corresponding to the maximum depth D9 of the throat 110 and the protuberances 118) than at 12 o'clock (corresponding to the minimum depth D12 of the throat and the dimples 116).

By providing a contoured surface having predetermined surface irregularities at predetermined locations, the coverage angle of audible sound emitted by a loudspeaker coupled with the horn 100 may be defined for at least three design planes. The first design plane may be a plane including the longitudinal axis of the horn 100 and the 9 o'clock position (i.e., the x-z plane as shown in FIGS. 1-9). The second design plane may be a plane including the longitudinal axis of the horn 100 and the 12 o'clock position (i.e., the y-z plane as shown in FIGS. 1-9). The third design plane may be any other plane including the longitudinal axis of the horn and positioned oblique to the first and second planes.

The horn or waveguide as described herein may be configured to provide a substantially predefined coverage angle or direction of sound waves in any plane intersecting the horn or waveguide axis (e.g., the longitudinal axis). The predefined coverage angles in a plurality of different planes each including the horn or waveguide axis may collectively define a predefined coverage pattern of sound waves provided by the horn or waveguide. The coverage pattern of sound waves may be substantially predefined without regard to the horn shape, which may enable independence between the horn shape and the coverage pattern. Any suitable method of horn profile geometry design may be applied to an arbitrary number of oblique planes to provide a horn or waveguide configured to provide a defined coverage pattern of sound waves in the oblique planes. In one example, the contoured surface may be configured such that the coverage pattern of sound waves produced by the loudspeaker may be defined in each of a plurality of oblique planes. The transitions between sections may be blended to reduce diffraction. For example, the contoured surface may taper continuously from one design plane to an adjacent design plane to reduce diffraction. In this manner, the coverage pattern may be independent of the shape of the horn or waveguide (e.g., the shape of the entrance and/or the mouth). The coverage pattern, which may be formed from a combination of coverage angles in the plurality of planes may be rectangular, elliptical, or any other shape. For example, an elliptical horn or waveguide may produce an elliptical coverage pattern, an elliptical horn or waveguide may produce a rectangular coverage pattern, a rectangular horn or waveguide may produce an elliptical coverage pattern, a rectangular horn or waveguide may produce a rectangular coverage pattern, or an amoeba shaped horn or waveguide may produce a trapezoidal coverage pattern. In other examples, a horn or waveguide having any shape may produce a coverage pattern having any shape. Because the horn or waveguide may be configured to provide a desired coverage pattern of audible sound waves in the plurality of design planes (e.g., design planes in addition to horizontal and/or vertical planes), the frequency response and/or directivity anomalies of sound waves produced by the loudspeaker may be reduced as compared to horn designs with less than three design planes. Because horn geometry may be defined from the central horn axis outward, internal reflections may be reduced and/or frequency response may be improved as compared to horn designs with less than three design planes.

FIGS. 12-19 illustrate another example of a horn 200, which may define the coverage angle of a loudspeaker in three or more planes. The horn 200 includes an entrance 202 positioned at a first axial end of the horn 100. The entrance 202 may be positioned on an entrance plane as described above with reference to the horn 100. In the example shown in FIGS. 12-19, the entrance 202 has a circular shape. The horn 200 includes a mouth 206 disposed at a second axial end of the horn opposite the entrance 202. The mouth 206 may be planar or non-planar. For example, the mouth may be disposed on a plane that is substantially parallel to the entrance plane. Alternatively, the mouth 206 may be curved as shown in FIGS. 12-19. The mouth 206 may be disposed on a surface having a radius of curvature about the entrance 202. In the example shown FIGS. 12-19, the mouth 206 has a rectangular shape. In other examples, the entrance 202 and the mouth 206 may have any other shape. The horn 200 includes a contoured surface 208 extending between the entrance 202 and the mouth 206. The horn 200 includes a throat 210 extending between the entrance 202 and the contoured surface 208. In the example shown in FIGS. 12-19, the throat 210 extends from the entrance 202 to a first axial end 212 of the contoured surface 208 to couple the contoured surface and the entrance to one another. The depth of the throat 210 may vary around the circumference of the throat as described above with reference to the horn 100.

Figure 19:
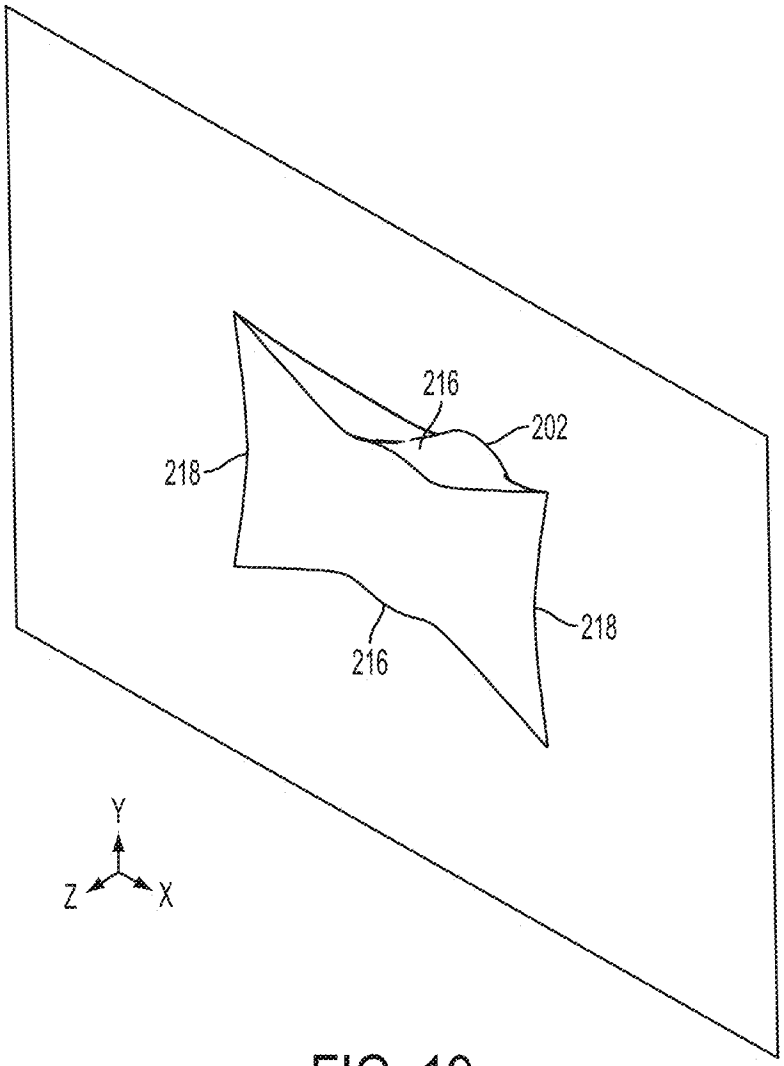
FIG. 19 illustrates a transverse cross sectional view of the horn of FIG. 12.

The contoured surface 208 may include one or more predetermined surface irregularities or surface variations. For example, the contoured surface 208 may include dimples 216 and/or protuberances 218 positioned at various positions along the contoured surface. FIG. 19 shows a cross section of the horn 200 taken transverse to the longitudinal axis of the horn at the longitudinal position of the dimples 216 and the protuberances 218. The cross section of the horn 200 may have a shape that is a non-polygonal closed curve that is neither a circle, an ellipse, nor a rectangle as shown in FIG. 19. In other words, the cross section may be a non-polygonal, non-circular, non-elliptical, non-rectangular closed curve. The contoured surface 208 may vary in circumferential and/or longitudinal directions. In one example, the contoured surface 208 may vary continuously. For example, the contoured surface 208 may taper in the longitudinal and/or circumferential directions. In another example, the contoured surface may include discontinuous or abrupt transitions. For example, the contoured surface 208 may include a step, an offset, a stagger, a shoulder, a depression, and/or a dome in the longitudinal and/or circumferential directions.

The horn 200 may include a plurality of walls that collectively define the contoured surface 208. For example, the horn 200 may include four walls as shown in FIGS. 12-19. The horn 200 may include a first pair of walls 220 positioned opposite one another and a second pair of walls 222 positioned opposite one another. The first pair of walls may be mirror images of one another. Additionally, or alternatively, the second pair of walls may be mirror images of one another. In other examples, the horn may include any number of walls (e.g., three, five, or more) that collectively form the contoured surface. The first pair of walls 220 and the second pair of walls 222 may be arranged relative to one another to form the contoured surface 208 of the horn 200. To that end, each wall 220 may be joined to an adjacent wall 222 at a joint 224. The joint 224 may extend longitudinally between the entrance 202 and the mouth 206 of the horn 200. For example, each joint 224 may extend longitudinally from the first axial end 212 of the contoured surface 208 to the mouth 206. The walls 220 and 222 may be formed as a unitary structure or formed separately and joined to one another to form the contoured surface 208. The walls 220 and 222 may flare outward as shown in FIGS. 12-19. In other examples, the walls may extend straight (e.g., planar), curve inward, or have any other desired configuration.

One or more of the walls of the horn 200 may include a predetermined surface irregularity. For example, each wall 220 may include a dimple 216, and each wall 222 may include a protuberance 218 as shown in FIGS. 12-19. The dimples 216 may extend outward away from the longitudinal axis of the horn 200 and into the contoured surface 208. The protuberances 218 may protrude inward toward the longitudinal axis of the horn 200 and outward from the contoured surface 208. In this manner, the contoured surface 208 may have an irregular or non-uniform shape defined by the surface irregularities. The dimples 216 may be positioned approximately at the 12 o'clock and 6 o'clock positions. The protuberances 218 may be positioned approximately at the 3 o'clock and 9 o'clock positions. In other examples, the surface irregularities may be positioned at any other circumferential and/or longitudinal position along the contoured surface. The coverage pattern of audible sound emitted by a loudspeaker coupled with the horn 200 may depend on the size, shape, and/or placement of the surface irregularities. In this manner, the coverage pattern of audible sound emitted by a loudspeaker coupled with the horn 200 may be independent of the shape of the entrance 202 and/or the mouth 206 of the horn. In other words, the shape of the coverage pattern may be different than the shape of the entrance 202 and/or the mouth 206 of the horn. For example, the horn 200 having a substantially rectangular shaped mouth 206 may produce a non-rectangular coverage pattern. This may enable a coverage pattern of any desired shape to be produced using a horn having an entrance and/or a mouth of any desired shape as further described below. The contoured surface 208 may taper continuously to provide substantially smooth transitions between predetermined surface features as further described below.

Two planes, each including the longitudinal axis of the horn 200, may divide the horn into four sections. For example, a first plane (e.g., a y-z plane) may extend between the 12 o'clock position and the 6 o'clock position, and a second plane (e.g., an x-z plane) may extend between the 3 o'clock position and the 9 o'clock position. An oblique plane (e.g., a plane that includes the longitudinal axis of the horn 200 and is oblique to the first and second planes) may intersect the first section of the horn 200 disposed between the 12 o'clock position and the 9 o'clock position. The intersection between the oblique plane and the horn 200 (e.g., the contoured surface 208 and/or the throat 210) may be a continuous curve. For example, the intersection may be an unbroken curve extending continuously from the entrance 202 to the mouth 206. In one example, the unbroken curve may include at least a portion of the entrance 202, the throat 210, and the contoured surface 208. In another example, the unbroken curve may include at least a portion of the entrance 202 and the contoured surface 208. For example, the oblique plane may intersect the horn at a circumferential position at which the contoured surface 208 is in contact with the entrance 202 as described above with reference to the horn 100. In one example, the contoured surface 208 may vary in the circumferential and longitudinal directions such that the intersection between the contoured surface 208 and/or the throat 210 of a section of the horn 200 and any plane including the longitudinal axis of the horn and positioned oblique to the first and second planes (e.g., any oblique plane) may be a continuous curve extending between the entrance 202 and the mouth 206.

By providing a contoured surface having predetermined surface irregularities at predetermined locations, the coverage angle of audible sound emitted by a loudspeaker coupled with the horn 200 may be defined for at least three design planes (e.g., the first plane, the second plane, and an oblique plane). In this manner, the horn 200 may be configured to provide a substantially predefined coverage angle or direction of sound waves in any plane intersecting the longitudinal axis. The predefined coverage angles in a plurality of different planes each including the longitudinal axis may collectively define a predefined coverage pattern of sound waves provided by the horn or waveguide. In this manner, the coverage angles in the plurality of design planes may collectively define the shape (e.g., the transverse cross sectional shape) of the coverage pattern. The coverage pattern of sound waves may be substantially predefined without regard to the horn shape, which may enable independence between the horn shape and the coverage pattern and/or reduce diffraction as described above. The coverage pattern, which may be formed from a combination of coverage angles in the plurality of planes may be rectangular, elliptical, or any other shape. For example, an elliptical horn or waveguide may produce an elliptical coverage pattern, an elliptical horn or waveguide may produce a rectangular coverage pattern, a rectangular horn or waveguide may produce an elliptical coverage pattern, a rectangular horn or waveguide may produce a rectangular coverage pattern, or an amoeba shaped horn or waveguide may produce a trapezoidal coverage pattern. In other examples, a horn or waveguide having any shape may produce a coverage pattern having any shape. Because the horn or waveguide may be configured to provide a desired coverage pattern of audible sound waves in the plurality of design planes (e.g., design planes in addition to horizontal and/or vertical planes), the frequency response and/or directivity anomalies of sound waves produced by the loudspeaker may be reduced as compared to horn designs with less than three design planes. Because horn geometry may be defined from the central horn axis outward, internal reflections may be reduced and/or frequency response may be improved as compared to horn designs with less than three design planes.

In one example, a method for forming a horn for use with a loudspeaker e.g., the horn 100 or the horn 200 described above) may include selecting a first design plane including a longitudinal axis of the horn, selecting a second design plane including the longitudinal axis of the horn and being perpendicular to the first design plane, and selecting a third design plane including the longitudinal axis of the horn and being oblique to each of the first design plane and the second design plane. The first design plane and the second design plane may be a horizontal design plane and a vertical design plane, respectively, as described above. Additionally, or alternatively, the third design plane may be an oblique design plane as described above.

The method may include selecting a first predetermined coverage angle in the first design plane, selecting a second predetermined coverage angle in the second design plane, and selecting a third predetermined coverage angle in the third design plane. The first predetermined coverage angle, the second predetermined coverage angle, and the third predetermined coverage angle may collectively define a predetermined coverage pattern of audible sound emitted by a driver coupled with the horn as described above. Each of the first predetermined coverage angle, the second predetermined coverage angle, and the third predetermined coverage angle may be independent of the others of the first predetermined coverage angle, the second predetermined coverage angle, and the third predetermined coverage angle. Additionally, or alternatively, each of the first predetermined coverage angle, the second predetermined coverage angle, and the third predetermined coverage angle may be independent of the shape of the entrance and/or the mouth of the horn as described above.

The method may include forming a contoured surface of the horn such that an intersection of the first design plane with the contoured surface is a first continuous curve having a first function corresponding to the first predetermined coverage angle, an intersection of the second design plane with the contoured surface is a second continuous curve having a second function corresponding to the second predetermined coverage angle, and an intersection of the third design plane with the contoured surface is a third continuous curve having a third function corresponding to the third predetermined coverage angle. The third function may not be a function of the first function and the second function. Additionally, or alternatively, a first cross sectional shape of the contoured surface along the first design plane may correspond to the first predetermined coverage angle, a second cross sectional shape of the contoured surface along the second design plane may correspond to the second predetermined coverage angle, and a third cross sectional shape of the contoured surface along the third design plane may correspond to the third predetermined coverage angle.

While various examples of the invention have been described, it will be apparent to those of ordinary skill in the art that many more examples and implementations are possible within the scope of the invention. Accordingly, the invention is not to be restricted except in light of the attached claims and their equivalents.

I claim:

1. A horn for use with a loudspeaker, the horn comprising:
an entrance disposed at a first axial end of the horn and configured to receive a driver;
a mouth disposed at a second axial end of the horn opposite the entrance; and
a contoured surface extending between the entrance and the mouth, the contoured surface comprising at least one irregularity, the at least one irregularity including at least one dimple in the contoured surface centered on a 12 o'clock position of the contoured surface;
where a cross sectional shape of a coverage pattern of audible sound emitted by the driver coupled with the horn is independent of a shape of the entrance and a shape of the mouth.

2. The horn of claim 1, where the cross sectional shape of the coverage pattern is different than the shape of the entrance and the shape of the mouth.

3. The horn of claim 1, further comprising a throat extending longitudinally between the entrance and the contoured surface.

4. The horn of claim 1, where the cross sectional shape of the coverage pattern is dependent on the surface irregularity, and where the at least one dimple in the contoured surface includes at least two dimples positioned as mirror images on opposite sides of the entrance from one another along an axis bisecting the entrance.

5. The horn of claim 4, where the surface irregularity comprises at least one protuberance from the contoured surface.

6. The horn of claim 1, where the shape of the mouth is elliptical, and a transverse cross section of the contoured surface at a longitudinal position between the entrance and the mouth comprises a non-circular, non-elliptical closed curve.

7. The horn of claim 1, where the shape of the mouth is rectangular, and a transverse cross section of the contoured surface at a longitudinal position between the entrance and the mouth comprises a non-rectangular closed curve.

8. A horn for use with a loudspeaker, the horn comprising:
an entrance disposed at a first axial end of the horn and positioned on an entrance plane, the entrance configured to receive a driver;
a mouth disposed at a second axial end of the horn opposite the entrance; and
a contoured surface extending between the entrance and the mouth and defining a cavity within the horn, the contoured surface comprising at least one surface irregularity, the at least one surface irregularity including at least one dimple in the contoured surface;
where the contoured surface comprises a transverse cross sectional shape at a longitudinal position of the surface irregularity that is different than both a shape of the entrance and a shape of the mouth; and
where the contoured surface comprises four walls, each wall joined to two other walls at joints, each joint extending smoothly from the entrance to the mouth in a plane which includes a longitudinal axis of the horn.

9. The horn of claim 8, further comprising a throat extending longitudinally between the entrance and the contoured surface, where a longitudinal depth of the throat varies circumferentially around the throat, a transition between the throat and the contoured surface being one or more of discontinuous, abrupt, and stepped.

10. The horn of claim 8, where the shape of the mouth is elliptical, and the transverse cross sectional shape of the contoured surface at the longitudinal position of the surface irregularity is non-elliptical and non-circular.

11. The horn of claim 8, where the shape of the mouth is rectangular, and the transverse cross sectional shape of the contoured surface at the longitudinal position of the surface irregularity is non-rectangular, and where the joints are portions of the contoured surface at a greatest radial distance from the longitudinal axis of the horn.

12. The horn of claim 8, where a reference plane is perpendicular to the longitudinal axis of the horn and positioned longitudinally between the entrance and the mouth, and a distance between the longitudinal axis and the contoured surface along the reference plane varies circumferentially around the longitudinal axis in a continuous manner, and where each surface irregularity is located on exactly one wall.

13. The horn of claim 8, where any plane including the longitudinal axis of the horn intersects the horn at a continuous curve extending from the entrance to the mouth, and where each surface irregularity comprises a smooth deformation of a wall.

14. A horn for use with a loudspeaker, the horn comprising:

an entrance disposed at a first axial end of the horn and configured to receive a driver;

a mouth disposed at a second axial end of the horn opposite the entrance; and a contoured surface extending between the entrance and the mouth, the contoured surface including at least one irregularity, the at least one irregularity including at least one dimple in the contoured surface centered on a 12 o'clock position of the contoured surface and at least one dimple in the contoured surface centered on a 6 o'clock position of the contoured surface;

where the horn comprises a horizontal design plane including a longitudinal axis of the horn, a vertical design plane perpendicular to the horizontal design plane and including the longitudinal axis of the horn, and a plurality of oblique design planes each including the longitudinal axis of the horn and being oblique to the horizontal design plane and the vertical design plane, where an intersection between each of the plurality of oblique design planes and a section of the horn is a continuous curve extending from the entrance to the mouth; and where a shape of a coverage pattern of audible sound emitted by the driver coupled with the horn is different than a shape of the entrance and a shape of the mouth.

15. The horn of claim 14, further comprising a throat extending longitudinally between the entrance and the contoured surface, where a depth of the throat varies circumferentially around the longitudinal axis of the horn.

16. The horn of claim 14, where the contoured surface comprises a plurality of surface irregularities, at least one of the plurality of surface irregularities including a protuberance in the contoured surface centered on a 3 o'clock position of the contoured surface and a protuberance in the contoured surface centered on a 9 o'clock position of the contoured surface.

17. The horn of claim 14, further comprising a first pair of walls positioned opposite one another and a second pair of walls positioned opposite one another, each of the first pair of walls joined to an adjacent one of the second pair of walls at a joint, the first pair of walls and the second pair of walls collectively defining a cavity of the horn.

18. The horn of claim 17, where each of the first pair of walls comprises a dimple in the wall and each of the second pair of walls comprises a protuberance protruding from the wall.

19. The horn of claim 17, where the shape of the mouth is rectangular, and a transverse cross sectional shape of the cavity at a longitudinal position between the entrance and the mouth is non-rectangular.

20. The horn of claim 14, further comprising a cavity defined by the contoured surface, where the shape of the mouth is elliptical, and a transverse cross sectional shape of the cavity is non-circular and non-elliptical.

* * * * *